US007261138B2

(12) United States Patent
Judkins et al.

(10) Patent No.: US 7,261,138 B2
(45) Date of Patent: Aug. 28, 2007

(54) CHILD SAFE CORD LOCK

(76) Inventors: Ren Judkins, 46 Newgate Rd., Pittsburgh, PA (US) 15202; Landon Lee Judkins, 46 Newgate Rd., Pittsburgh, PA (US) 15202

( * ) Notice: Subject to any disclaimer, the term of this patent is extended or adjusted under 35 U.S.C. 154(b) by 354 days.

(21) Appl. No.: 10/725,971

(22) Filed: Dec. 2, 2003

(65) Prior Publication Data

US 2005/0115684 A1 Jun. 2, 2005

(51) Int. Cl.
*E06B 9/324* (2006.01)

(52) U.S. Cl. ..... 160/178.2; 24/134 KB

(58) Field of Classification Search ..... 160/178.2, 160/168.1 R, 173 R; 24/134 KB; 114/199; 254/391

See application file for complete search history.

(56) References Cited

U.S. PATENT DOCUMENTS 580,319 A * 4/1897 Jenison ..... 188/64
1,036,232 A * 8/1912 Hedberg ..... 24/134 R
1,215,985 A * 2/1917 Plate ..... 160/168.1 R
2,132,991 A * 10/1938 Mintz ..... 160/168.1 R
2,731,111 A * 1/1956 Lorentzen ..... 188/64
3,294,153 A * 12/1966 Fountain ..... 160/168.1 R
3,727,665 A * 4/1973 Debs ..... 160/178.2
4,413,664 A 11/1983 Istha
5,275,222 A 1/1994 Jelic et al.
5,472,036 A * 12/1995 Judkins ..... 160/178.2
6,453,974 B1 9/2002 Lai et al.

* cited by examiner

*Primary Examiner*—Blair M. Johnson
(74) *Attorney, Agent, or Firm*—Buchanan Ingersoll & Rooney PC

(57) ABSTRACT

A cord lock for window coverings has one or more cams adjacent a surface over which a one or more lift cords travel. The cams are spring biased to a locked position in which they press the lift cords against the surface. A cam lock with a release cord is provided which engages and moves the cams from a locked position to an unlocked position in which the lift cords are free to move through the cord lock. The cord lock is always in a locked position whenever neither the lift cords are being pulled to raise the blind nor the release cord is being pulled to lower the blind.

7 Claims, 9 Drawing Sheets

CHILD SAFE CORD LOCK

FIELD OF INVENTION

The present invention relates to a cord lock for window blinds which are raised and lowered by lift cords such as venetian blinds.

BACKGROUND OF THE INVENTION

Venetians blinds have a headrail, a bottom rail and a set of slats carried on ladders that extend from the headrail to the bottom rail. Lift cords extend from the bottom rail through or adjacent the slats and into the headrail. The lift cords may be wound and unwound on an axle within the headrail, but more commonly pass through a cord lock in the headrail and exit the headrail at one end. Conventional cord locks will restrain the lift cords when the blind is in a fully raised, or partially lowered, position. But, typically those cord locks do not lock the cords in place when the blind is fully lowered. Consequently, anyone can grasp a lift cord of a fully lowered blind and pull the lift cord away from the blind until the end of the lift cord, which typically has a tassel, reaches the end of the headrail. When a lift cord is pulled in this way a loop is formed. Children have been known to do this. Indeed, some children have become entangled in a cord loop created in this way and have been strangled. Consequently, the industry has been encouraged to provide safety devices on venetian blinds to prevent cords from being pulled away from the slats. A similar problem can also occur in pleated shades and roman shades.

One solution to this problem that some manufacturers have adopted is to attach a cord stop to each lift cord. One type of cord stop has a donut shape. The lift cord is passed through the center hole and around the body. This type of cord stop is disclosed in U.S. Pat. No. 6,453,971. Another type of cord stop is a ball with a slot that snaps onto the cord. Even though the cord stops that have been used are made from clear plastic, they are quite noticeable and detract from the appearance of the blind. Furthermore, one stop must be attached to each lift cord by the installer after the blind has been mounted on the window. This adds several minutes to the installation of a single blind. Fabricators and installers who install cord stops on their blinds must spend more time on each job thereby increasing the cost of the installation.

There is a need for a mechanism that can be used in venetian blinds and other window coverings that will prevent lift cords from being pulled away from a fully lowered blind. That mechanism should not detract from either the operation or appearance of the blind.

U.S. Pat. No. 5,275,222 discloses a cord lock and release system for blinds having a stationary member and a moveable member between which the lift cords pass. In the preferred embodiments a spring biases the moveable member toward the stationary member to restrain the lift cords. A linkage, which typically is a release cord, is attached to the moveable member. The operator pulls the release cord to move the movable member away from the stationary member to release the lift cords. Since the moveable member is biased to the locked position the cords will normally be restrained. The patent also teaches that a spring is not required and that gravity could keep the moveable member in a locked position. But, without the spring, the moveable member is free to rotate 360° and become stuck in a release position. Even the spring biased system permits rotation of the moveable member through an arc greater than 90°. Another shortcoming of this system is that a single moveable member is provided to restrain all of the lift cords. Lift cords often vary in diameter within a single blind by a few thousandths of an inch. If two lift cords in a blind vary in diameter the movable member in a locked position will restrain the larger diameter cord but may allow the smaller diameter cord to slip past the moveable member. Consequently, there remains a need for a cord lock or other system that will prevent lift cords from being pulled away from a fully lowered blind and not detract from either the operation or appearance of the blind.

SUMMARY OF THE INVENTION

We provide a cord lock that retains the lift cords in a manner so that no lift cord can be pulled away from the window covering material in a fully lowered blind. Yet, the cord lock readily releases the cord when an operator pulls on the lift cords to raise the blinds. To lower the blind an operator pulls a release cord that extends from the cord lock.

Our cord lock has a generally rectangular housing containing at least one cam spaced apart from a surface over which one or more lift cords pass. In the preferred embodiments the surface is a wheel and there is one cam and one wheel for each lift cord. The cams can rotate about a first axis from at least one unlocked position to a locked position, and from the locked position to the unlocked position. The surface is spaced apart from the cam such that a cord passing over the surface will be pressed against the surface and restrained when the cam is in the locked position, and the cord can freely pass over the surface in at least one direction when the cam is in the at least one unlocked position.

We further provide a cam lock within the housing that is capable of assuming a first position in which the cams are in the locked position, and at least one additional position in which the cams are engaged by the cam lock and in an unlocked position. The cam lock limits the travel of the cams through an arc that preferably is less than 90°. The cam lock can be variously configured. In one embodiment the cam lock is a box-like carriage. In another preferred embodiment the cam lock is a pair of interlocking drums. In yet another embodiment the cam lock is a single wheel having a slot into which the cams are fitted. In still another embodiment the cam lock is a U-shaped housing that extends around the pivoting end of the cams.

A release cord is attached to the cam lock in a manner so that pulling the release cord moves the cam lock to engage and move the cams from the locked position to a release position in which the lift cords can freely move through the cord lock. One or more springs are attached to the cam lock, to the axle carrying the cams or directly to the cams, biasing the cams to the locked position. The spring has a strength that enables the cams to move from the locked position to the unlocked positions when an operator pulls the lift cords to raise the blind or pulls the release cord to lower the blind.

Other objects and advantages of our cord lock will become apparent from a description of certain present preferred embodiments shown in the drawings.

DETAILED DESCRIPTION OF THE PREFERRED EMBODIMENTS

Figure 1:
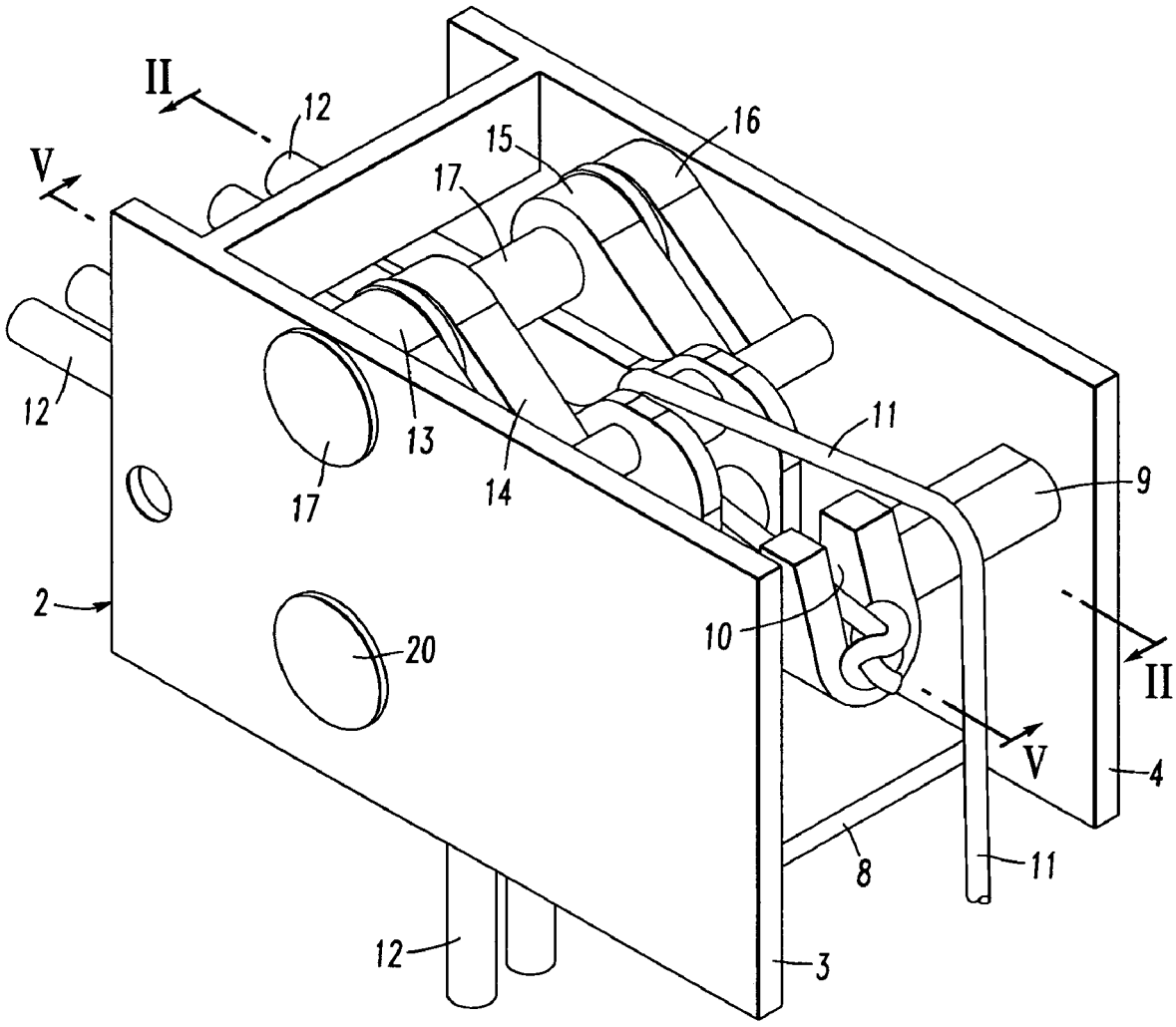
FIG. 1 is a perspective view of a first present preferred embodiment of our cord lock.

A first present preferred embodiment of our cord lock 1, shown in FIGS. 1 through 6, has a housing 2 formed from two spaced apart parallel sides 3 and 4 held together by front walls 5 and 6, bottom walls 7 and 8 and spacer 9. An inverted keyhole slot 10 is provided in the spacer 9 through which a release cord 11, shown only in FIG. 1, passes. The cord lock shown in FIGS. 1 though 6 is configured to accommodate four lift cords 12. As will be seen, other configurations could be provided to receive two, three, five, six or even more cords. However, for blinds having eight or more lift cords we prefer to use two or more cord locks.

Figure 2:
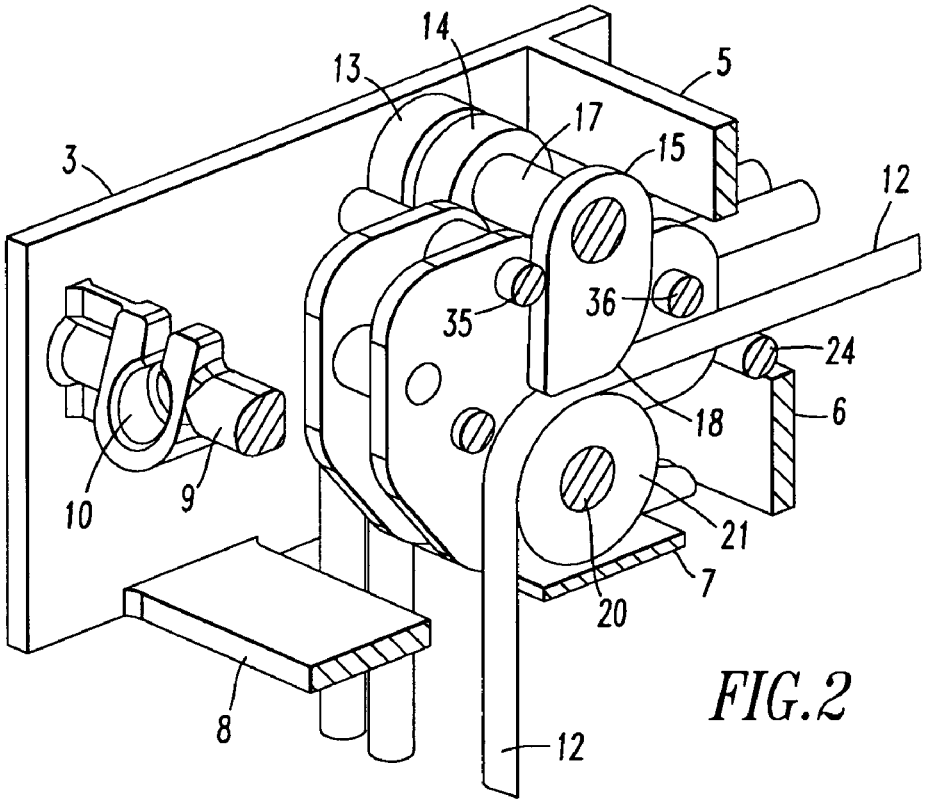
FIG. 2 is a sectional view along the line II-II of FIG. 1 showing the cord lock in a locked position and having no release cord.
Figure 3:
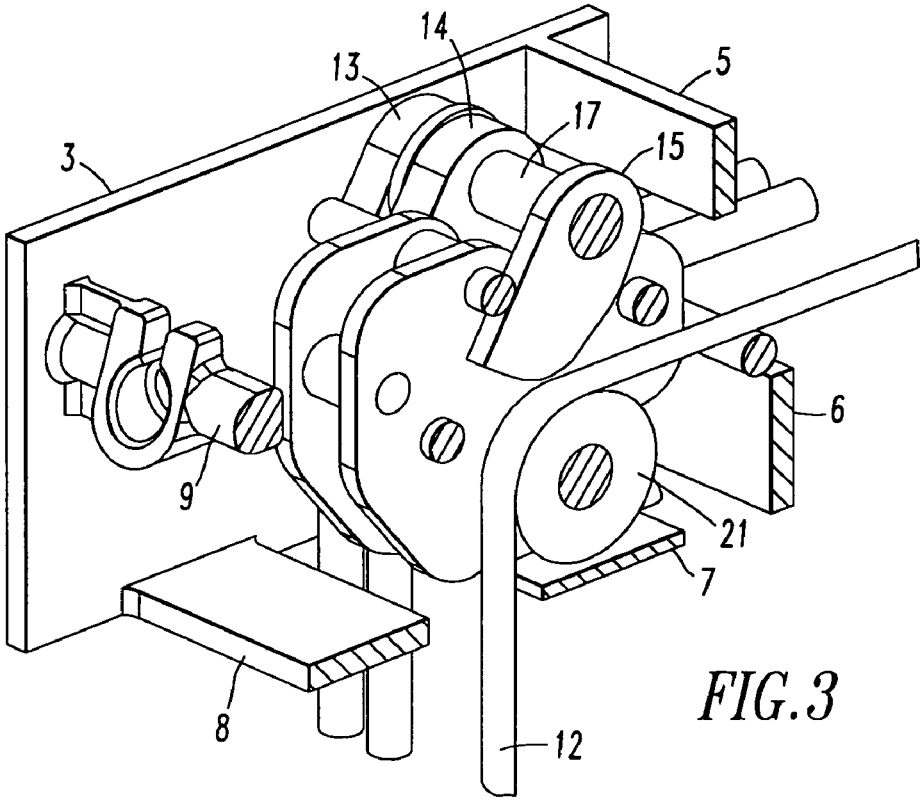
FIG. 3 is a sectional view similar to FIG. 2 showing the cord lock in a first unlocked position.
Figure 4:
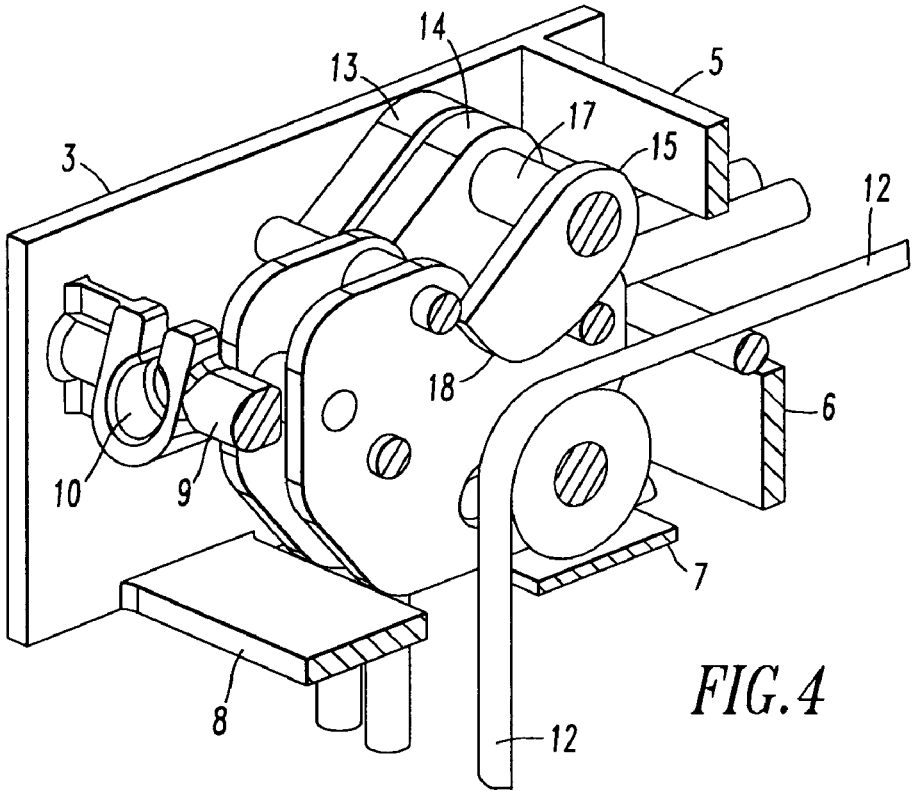
FIG. 4 is a sectional view similar to FIGS. 2 and 3 showing the cord lock in a second unlocked position or release position.
Figure 5:
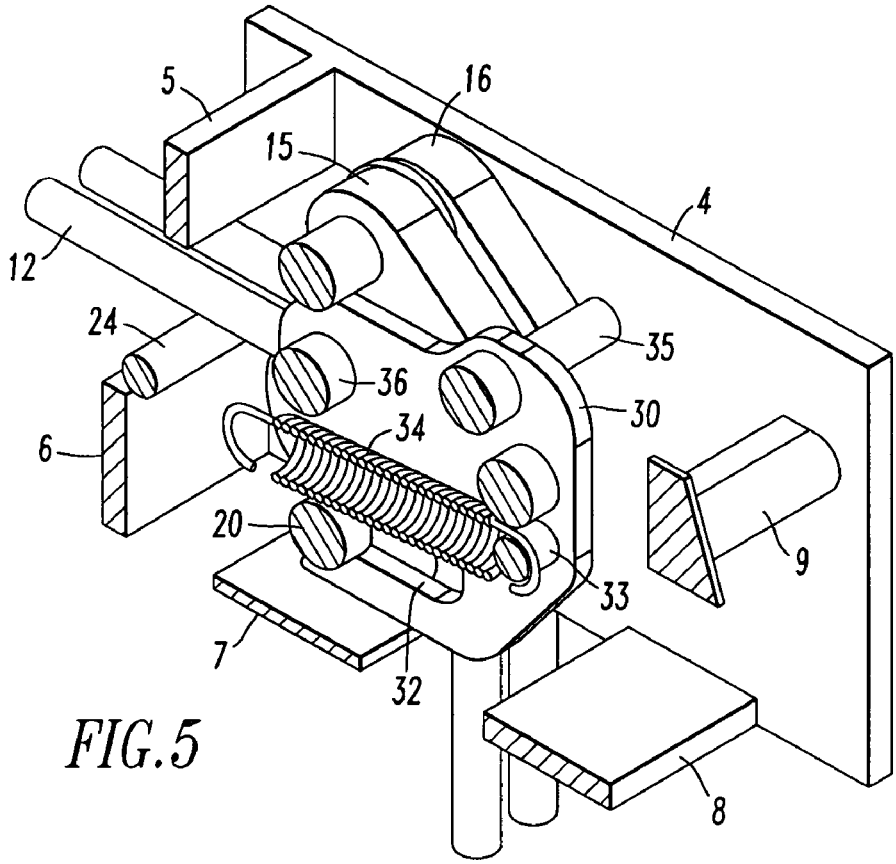
FIG. 5 is a sectional view taken along the line V-V of FIG. 1 showing the cord lock in the unlocked position shown in FIG. 4.
Figure 6:
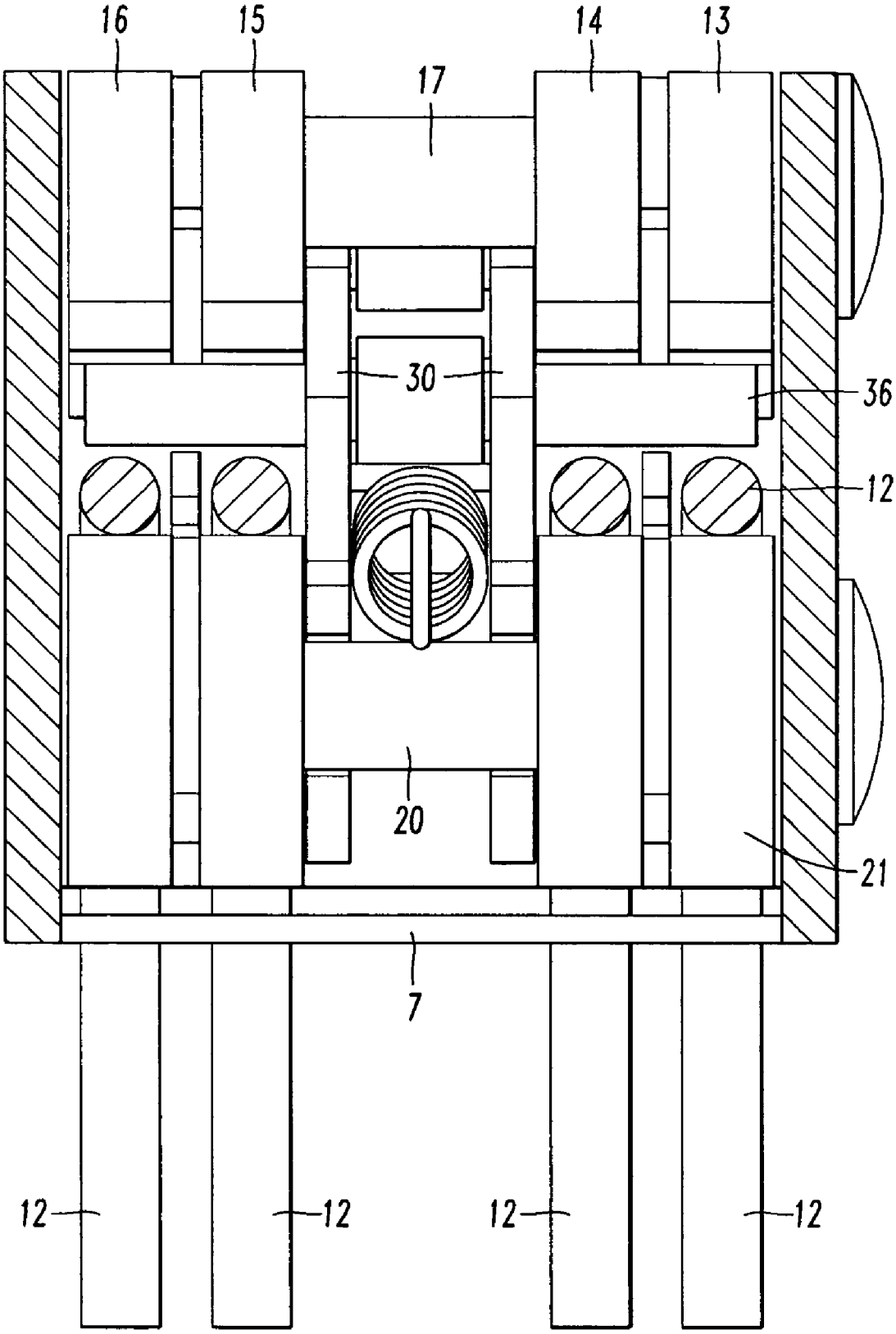
FIG. 6 is a sectional view taken along the line VI-VI in FIG. 1.

The operation of the cord lock can best be understood with reference to FIGS. 2, 3, and 4. Within the cord lock housing 2 we provide four cams 13, 14, 15 and 16 on a common pin 17 that passes through the housing. There is one cam for each lift cord 12. All of the cams rotate on a common axis defined by pin 17. We prefer to provide teeth or a serrated edge 18 on each cam which engage a lift cord 12 when the cam is in a locked position shown in FIG. 2. A second pin 20 passes through the housing 1 and is parallel to pin 17. Pin 20 carries a wheel or roller 21 over which the lift cord 12 rides. We prefer to provide a separate wheel for each cam, but a common roller could be used for all cams 13 through 16. If desired, a spacer can be placed between adjacent wheels and adjacent cams. Those spacers could extend to the front walls 5 and 6 of the cord lock. Furthermore, the wheels 21 could simply be fixed curved surfaces that do not move as a lift cord 12 passes over them. The relative positions of the cams 13 through 16 and the wheels 21 define cord paths between them through which the lift cords travel. The lift cords 12 enter the cord lock 1 between front walls 5 and 6 after passing from the window covering material. They pass over spacer rod 24, over wheel 21 and exit the cord lock between bottom walls 7 and 8. When the cams 13 through 16 are in the locked position shown in FIG. 2, each lift cord is pinched between a cam and a roller and the teeth 18 on each cam press into the cord. If one pulls on a lift cord where the cord passes through the blind slats or other window covering material, the cord will not move. Hence, a child pulling a lift cord away from the window covering material in a fully lowered blind could not create a loop in the cord. The lift cord would not move. Furthermore, the bottom rail of the blind cannot be lowered when the cams are in the locked position shown in FIG. 2. To raise the blind an operator pulls on the portion of the cord below the bottom of the cord lock. As can be seen in FIG. 3 that force turns wheel 21 and moves the cam to a first unlocked position. As the lift cords 12 are pulled to raise the blind, the cams ride on the lift cords. When the operator releases the lift cords the weight of the blind causes the lift cords to move in the opposite direction. As that motion begins the teeth 18 in the cams quickly engage the lift cords locking the blind in place. Once again the blind is in the locked position shown in FIG. 2. Teeth 18 should be angled to enable the cord to be easily released when pulled by the operator.

A movable cam lock or carriage 30, positioned between cams 14 and 15, has a slot 32 that enables the carriage to move back and forth over pin 20. A spring 34 is connected between pin 33 in the carriage and rod 24 biasing the carriage 30 to the locked position of FIG. 2. Pins 35 and 36 extend through the carriage 30 toward the sidewalls 3 and 4 of the housing 2. The pins 35 and 36 are positioned to capture the cams 13, 14, 15 and 16 between them. Consequently, the cam lock limits the movement of the cams. Movement of the carriage from the locked position shown in FIG. 2 to the release position shown in FIG. 4 will engage and move the cams 13, 14, 15 and 16 to a second unlocked position. Since the cams are now away from the lift cords those cords are free to move in either direction. Unless the lift cords are being held by the operator, the weight of the shade will pull the lift cords through the cord lock until the bottom rail hits the window sill or is otherwise restrained. The carriage can be moved to the release position by pulling on the release cord 11 shown in FIG. 1.

Having explained the operation of the cord lock, it should now be apparent how a blind equipped with our cord lock is operated. To raise the blind, an operator pulls the lift cords. To lower the shade, the operator pulls the release cord. It is not necessary to move the lift cords to one side through a plane parallel to the blind or through a plane perpendicular to the blind to lock or unlock the cord lock. This is another advantage over many conventional cord locks.

Figure 7:
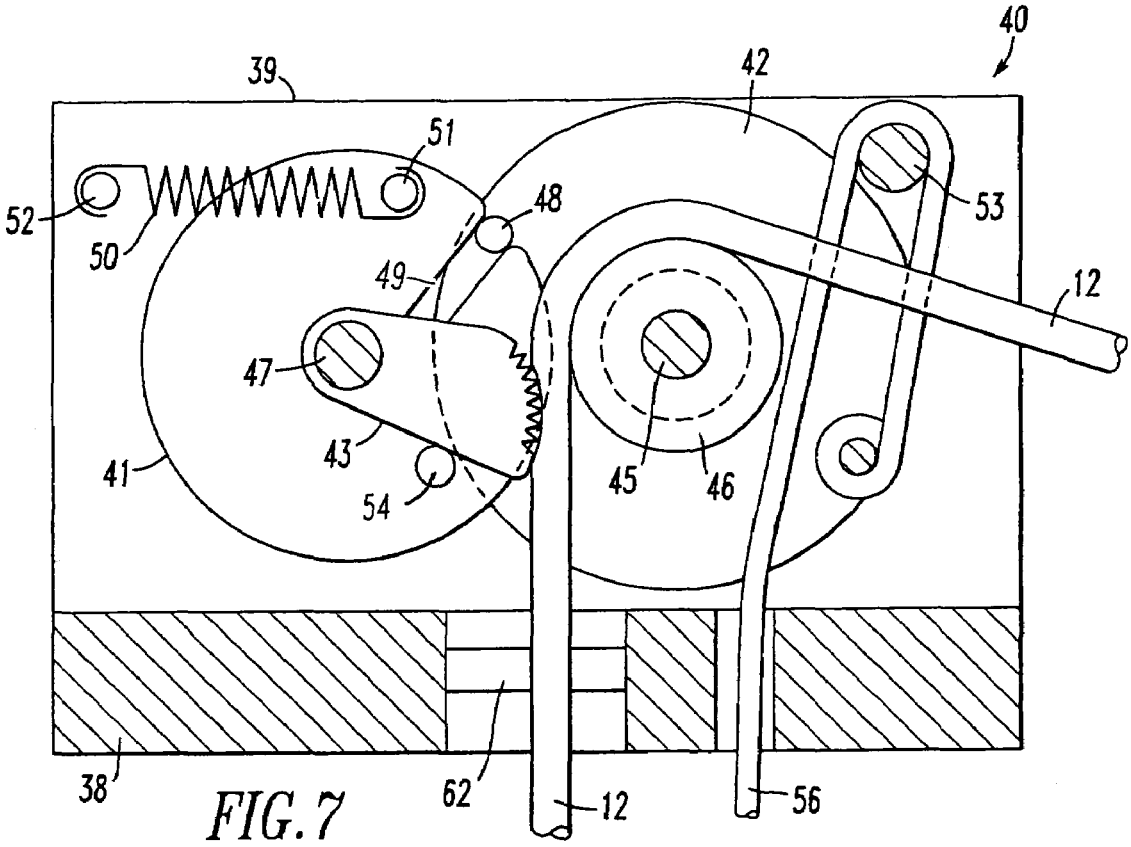
FIG. 7 is a sectional view similar to FIG. 2 of a second present preferred embodiment of our cord lock in a locked position.
Figure 8:
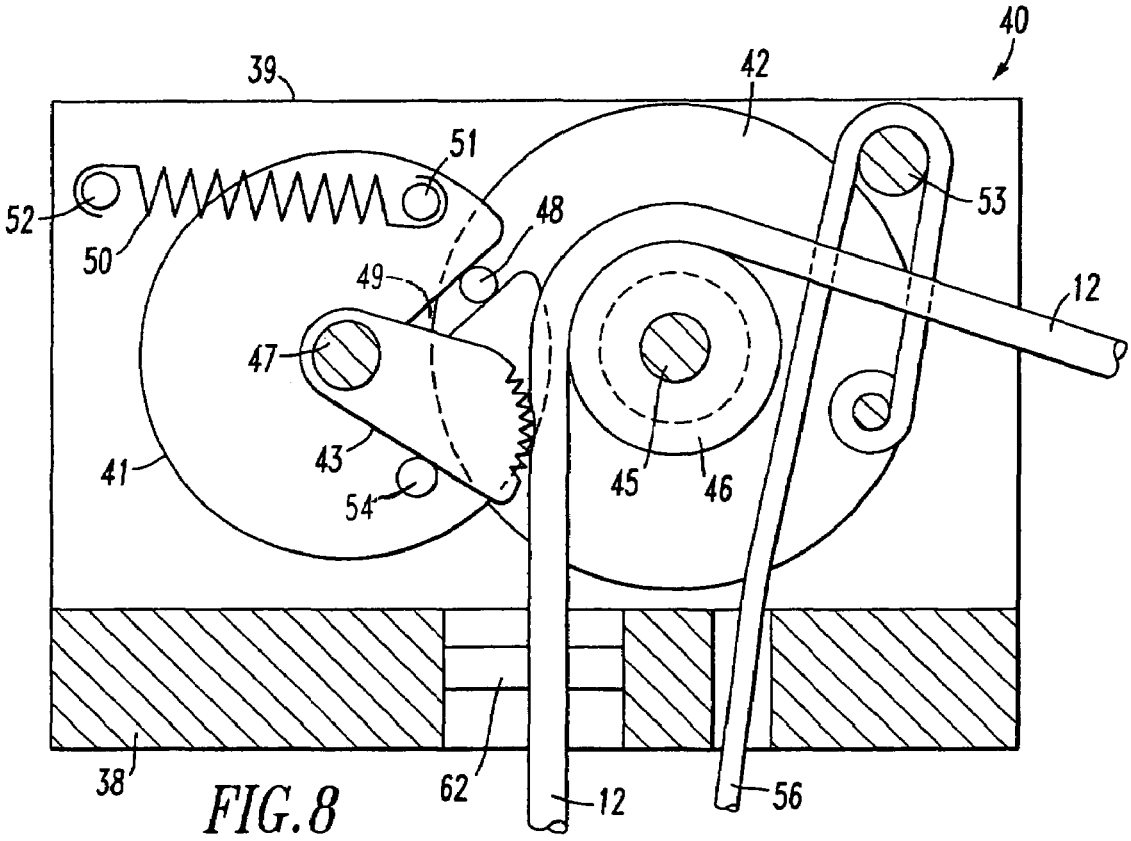
FIG. 8 is a sectional view similar to FIG. 7 of the second present preferred embodiment of a cord lock in a first unlocked position.
Figure 9:
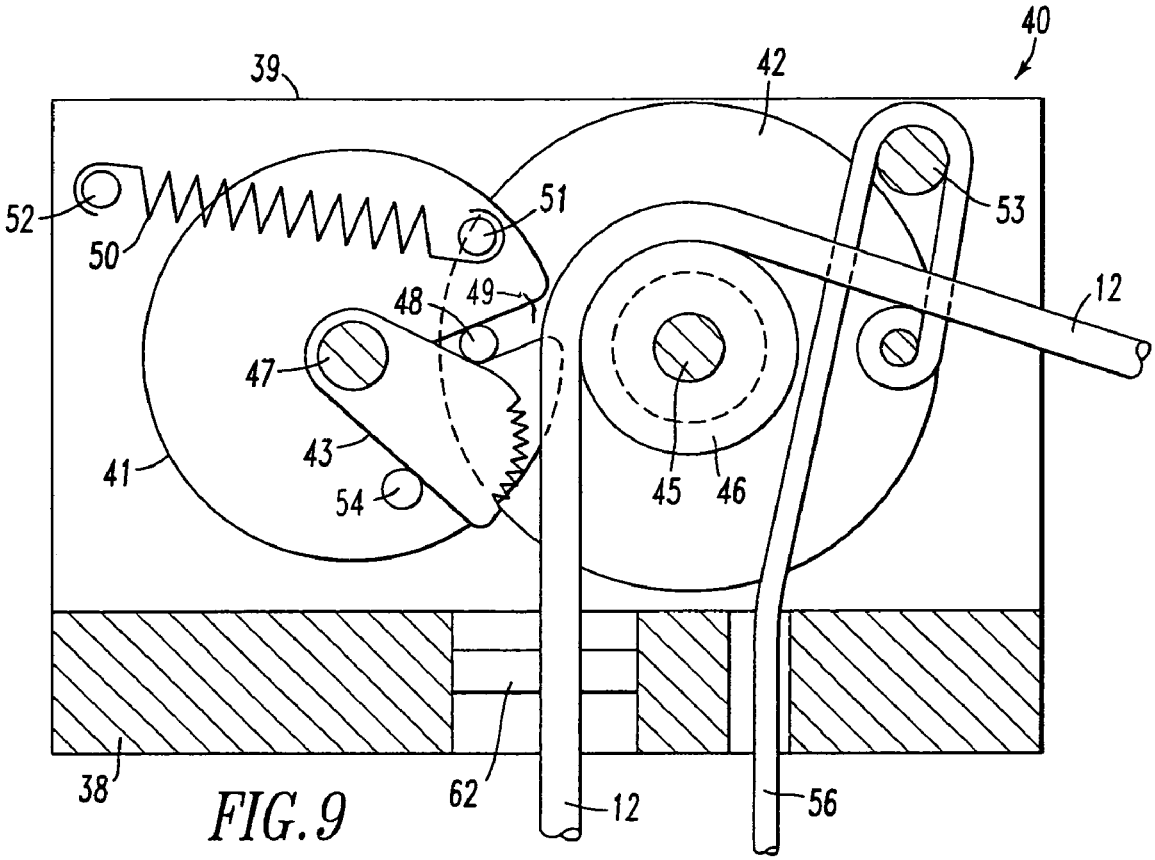
FIG. 9 is a sectional view similar to FIGS. 7 and 8 showing the second present preferred cord lock in a second unlocked position or release position.

In a second present preferred embodiment of our cord lock 40, shown in FIGS. 7, 8 and 9, the cam lock contains a pair of locking drums 41 and 42 in place of the carriage 30 of the first embodiment. In this embodiment, pin 47 extends through the housing 39 and carries the first locking drum 41 and four cams 43, two on each side of the locking drum 41. A second pin 45 extends through the housing and carries second locking drum 42 and two wheels 46, two on each side of the second locking drum. As in the first embodiment, a lift cord 12 passes between each set of cams and wheels. A slot 49 is provided in the first locking drum 41 which receives a pin 48 in the second locking drum 42. This slot and pin arrangement causes the two locking drums to move together. A spring 50 extends from pin 51 on the first locking drum 41 to a pin 52 extending from the housing as shown in FIG. 8. This biases the locking drums to the locked position shown in FIG. 7. If desired the spring could be connected between the second locking drum and the housing. A release cord 56 extends from pin 54 on locking wheel 42, passes over rod 53 and exits the bottom of the cord lock. The bottom 38 of the housing has a passage 60 through which the lift cords 12 pass. We prefer to provide guide pins 62 in the passage 60 to separate adjacent lift cords. Pulling the lift cords from below the cord lock moves the cams to an unlocked position shown in FIG. 8. Pins 51 and 54 extend through the first locking wheel 41 and capture the cams 43. Pulling the release cord turns both locking wheels 41, 42 until pin 51 moves the cams away from the lift cords to an unlocked position or release shown in FIG. 9. The drums need not be round but could be a polygon or have an irregular or non-symmetric shape.

Several variations could be made in the embodiments illustrated in FIGS. 1 through 9. In both versions of the cord lock a spring was connected between the housing and the cam lock, namely carriage 30 or locking drum 41 or 42. In an alternative embodiment one could attach the spring indirectly to the cams by a connection to the rod carrying the cams, particularly if the cross section of the rod is a polygon. The spring could directly engage the cams or one could provide individual springs for each cam. The use of individual springs for each cam enables each cam to move independently, thereby compensating for variations in the diameters of the cords. However, use of multiple springs is more expensive than the single spring embodiments shown in the drawings.

Figure 10:
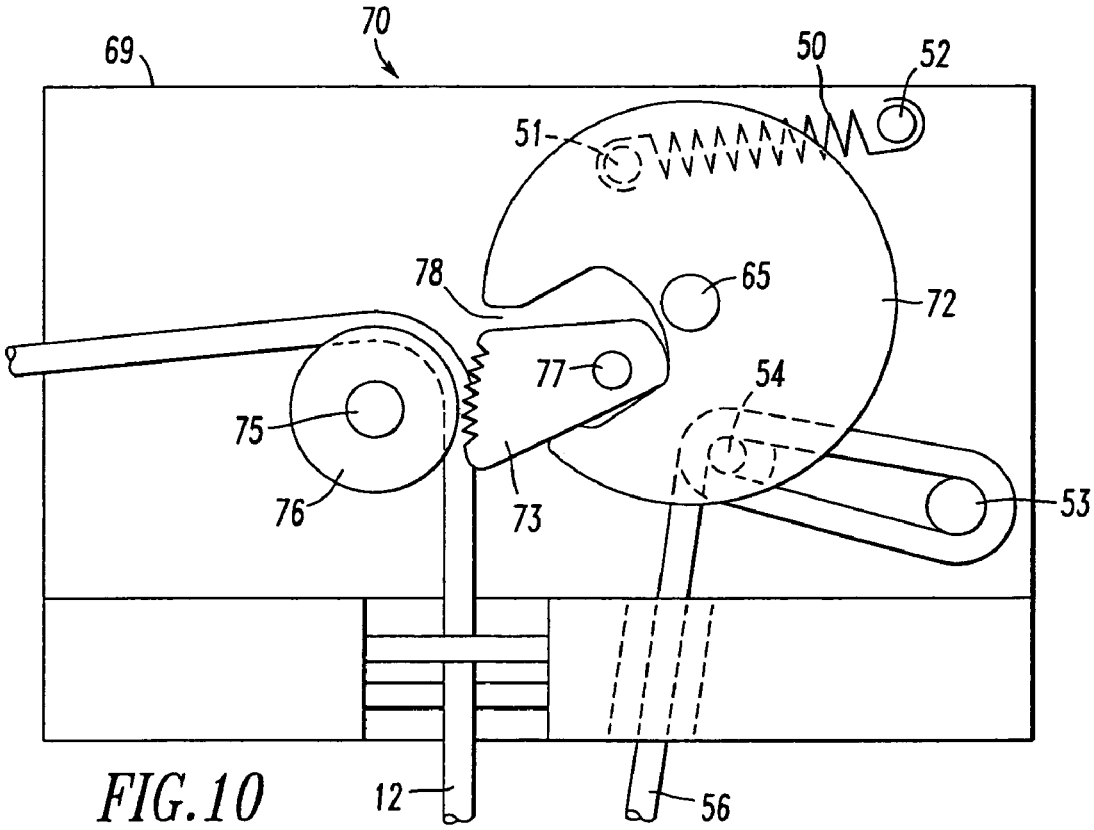
FIG. 10 is a sectional view similar to FIG. 7 of the third present preferred embodiment of our cord lock in a locked position.
Figure 11:
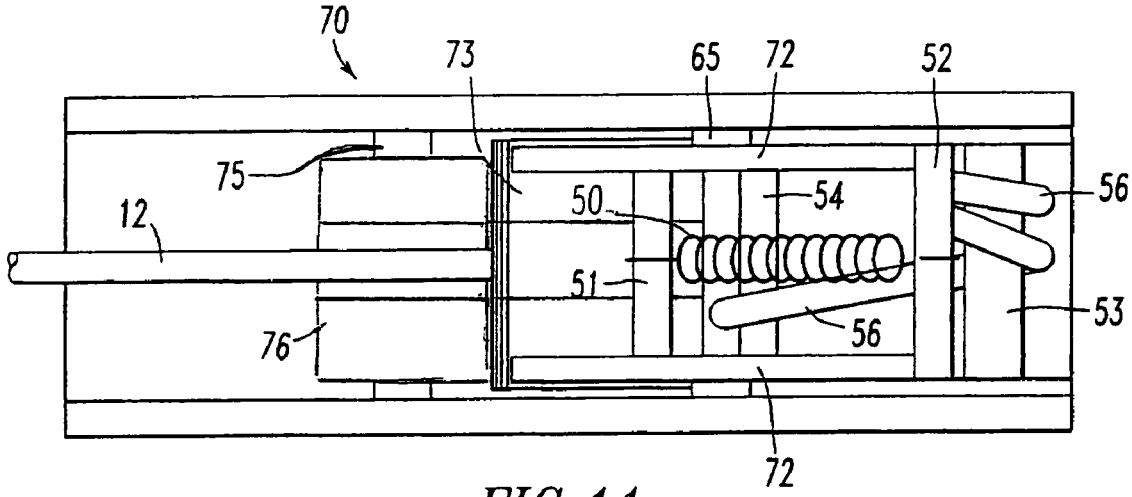
FIG. 11 is a top plan view of the third present preferred embodiment shown in FIG. 10.

The third present preferred embodiment of our cord lock 70 shown in FIGS. 10 and 11 is similar to the second embodiment. A cam lock wheel 72 is carried on axle 65 extending from housing 69. A second axle 75 carriers wheel 76 over which one or more lift cords 12 travel. Again we prefer to have a separate wheel for each lift cord. Cams 73 are carried on pin 77 and captured within a slot 78 in the cam lock wheel 72. As in the previous embodiment spring 50 biases the cam lock wheel 72 to the locked position shown in FIG. 10. Release cord 56 is attached to cam lock wheel 72, by pin 54 and travels around pin 53 before exiting the cord lock. As can be seen from the top view of the cord lock 70 in FIG. 11 this cord lock can be quite narrow. Consequently, two or even three cord locks can be placed side by side within the headrail.

A fourth present preferred embodiment of our cord lock 80 is shown in FIGS. 12 through 15. This cord lock 80 has a base 81 from which wall 82 extends. A second wall 83 is attached to the base 81 and wall 82. As can be most clearly seen in FIG. 15, wall 83 has a slot through which the lift cords 12 pass. The bottom edge 93 of that slot is angled relative to the base 83 and serves as a ramp. Axle 84 extends from wall 83 an carries cams 85 as well as bell-shaped cam lock 86. The cam lock 86 may be spring biased to the locked position shown in FIG. 12 or may be configured so that gravity pulls the cam lock to the locked position. The cams 85 are sufficiently away from the leading edge of bell-shaped cam lock 86 and wall 83 that an operator may move the lift cords 12 up ramp 93 from the position shown in dotted line in FIG. 15. This motion causes the leading edge of the cam lock 86 to rise moving the cams to the release position shown in FIG. 14. As in the previous embodiments the cam lock 86 allows the operator to pull the lift cords to raise the blind. When that happens the cams will be positioned as in FIG. 13. This cord lock is configured to fit into the end of a headrail. We prefer to provide a cover 88 over the slot 92 through which the lift cords exit the cord lock.

Figure 12:
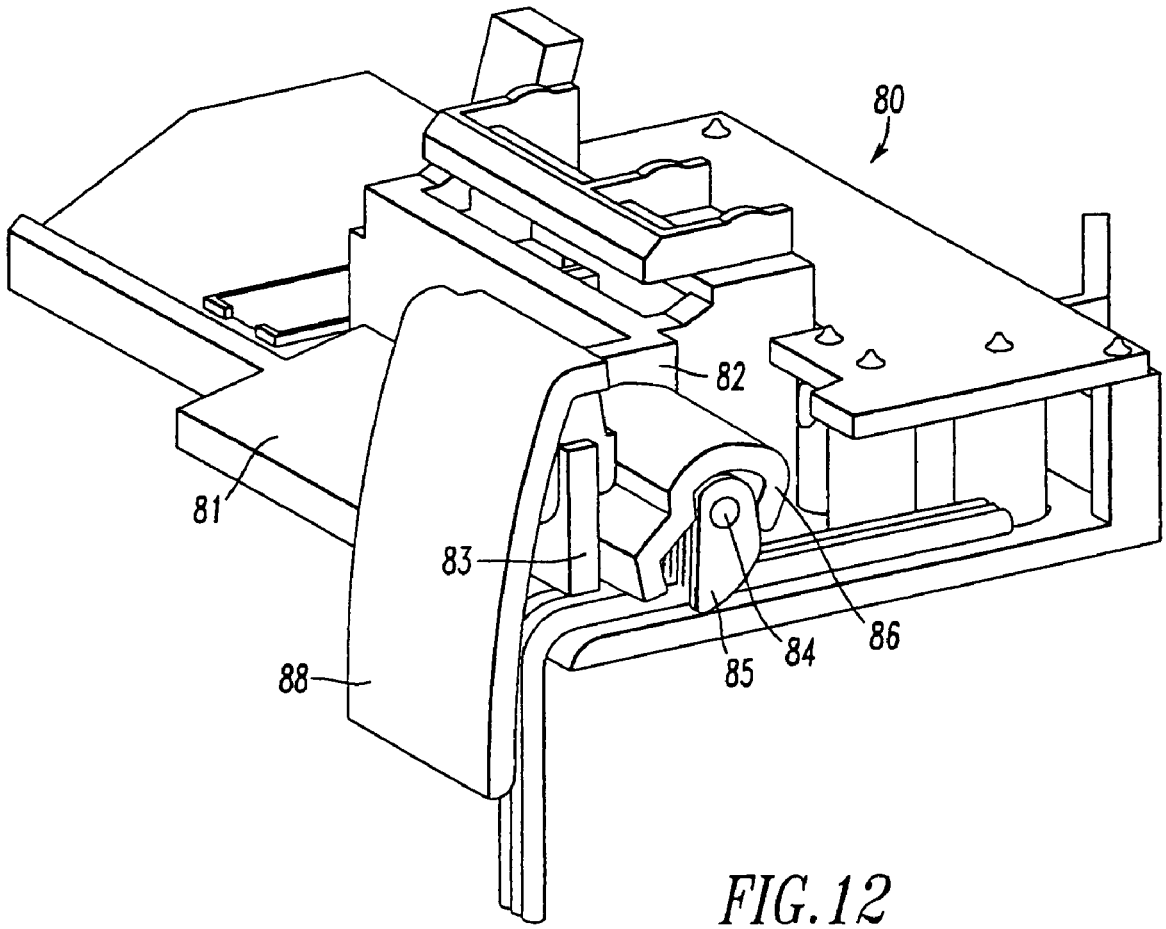
FIG. 12 is a perspective view of a fourth present preferred embodiment of our cord lock in a locked position.
Figure 13:
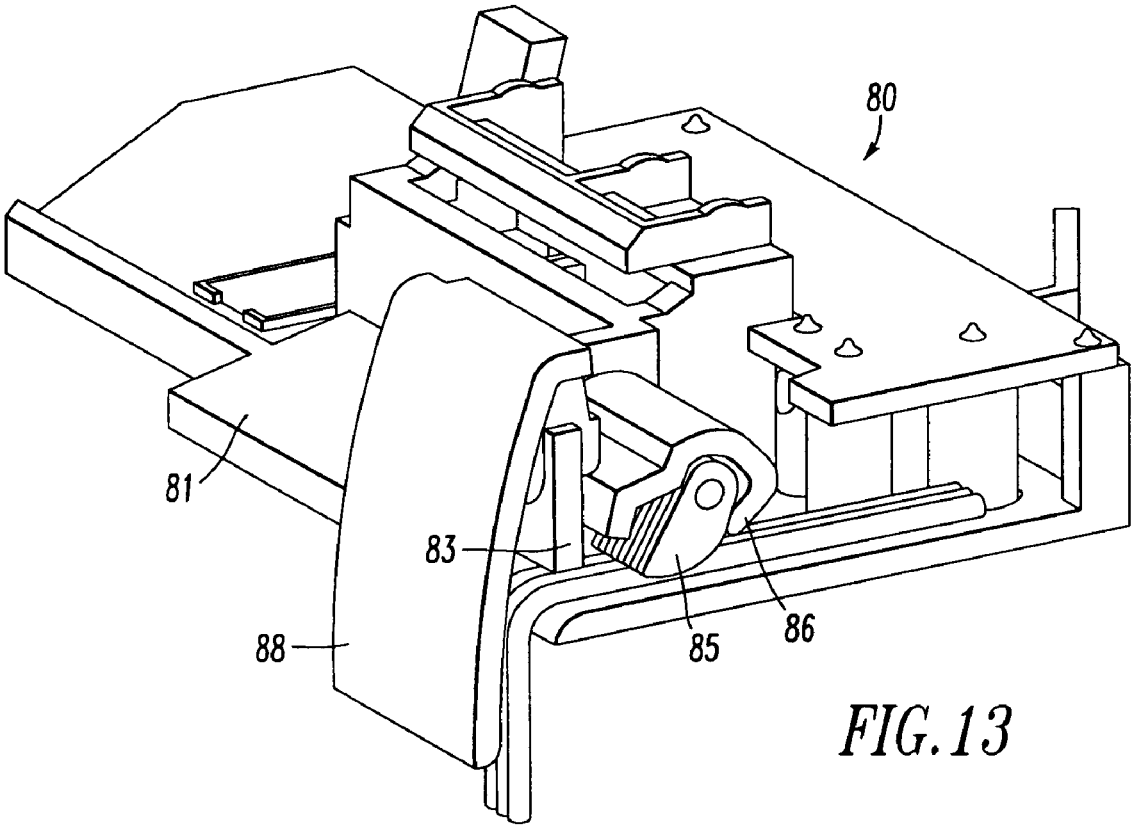
FIG. 13 is a perspective view similar to FIG. 12 of the fourth present preferred embodiment of a cord lock in a first unlocked position.
Figure 14:
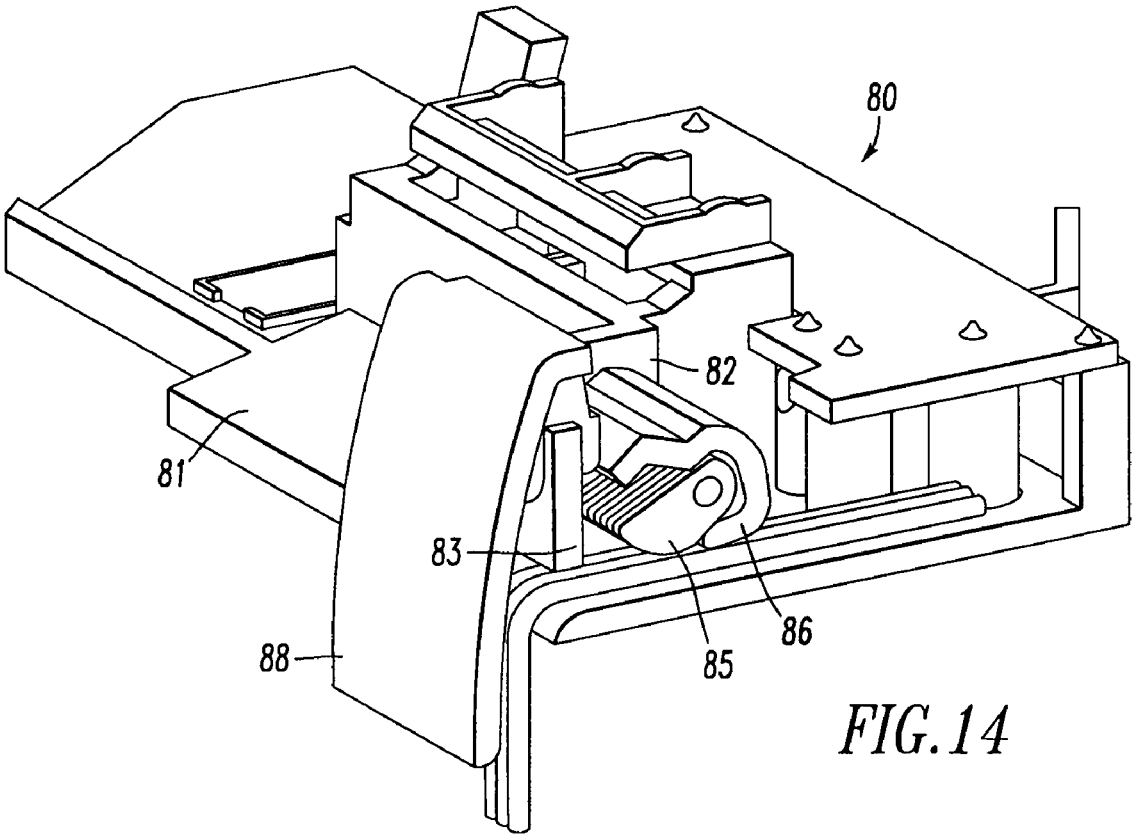
FIG. 14 is a perspective view similar to FIGS. 12 and 13 showing the fourth present preferred cord lock in a second unlocked position or release position.
Figure 15:
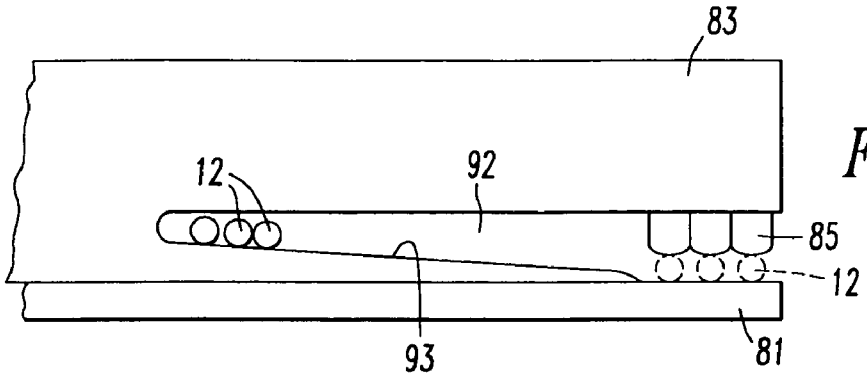
FIG. 15 is a front view of a portion of the cord lock shown in FIGS. 12, 13 and 14 showing the ramp over which the lift cords pass.
Figure 16:
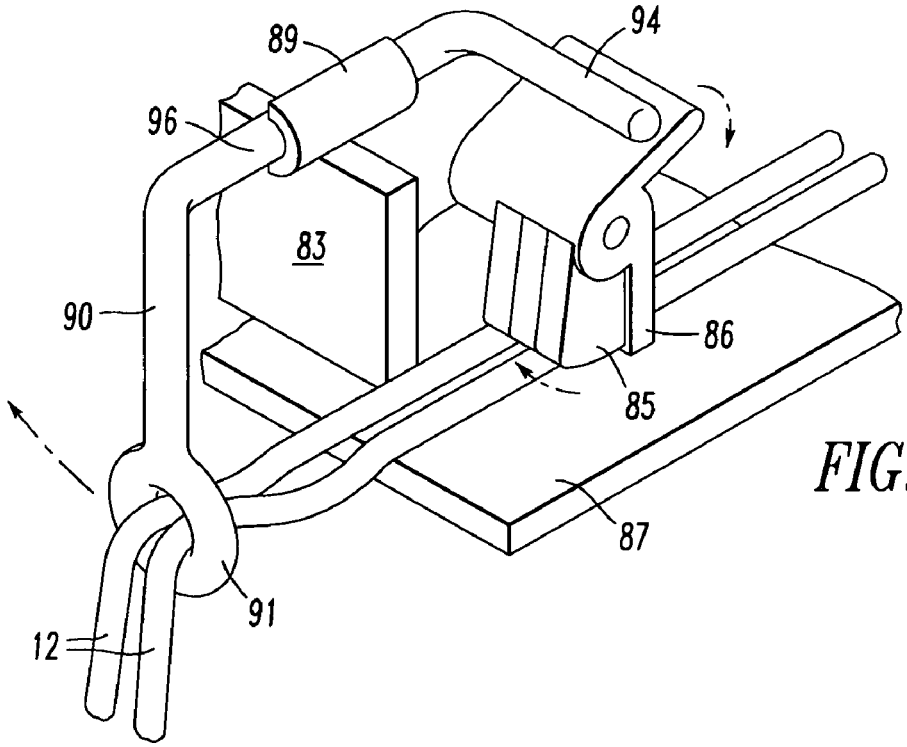
FIG. 16 is perspective view of a cam lock lift mechanism that can replace the ramp in the fourth present preferred embodiment shown in FIGS. 12 through 15.

The cord lock shown in FIGS. 12 through 14 could be alternately configured to have a release arm 90 shown in FIG. 16. A carrier 89 is attached to the top of wall 83. Release arm 90 has a two bends that define a central portion 96 that is held by the carrier 89. The front portion of the release arm has an eyelet 91 through which the lift cords 12 pass. The opposite end of the release arm is bent to provide a trip bar portion 94. When the operator moves the lift cords to the left, the central portion of the release arm rotates within the carrier and the trip bar portion moves down engaging the cam lock. As indicated by the arrows in FIG. 16, this motion causes the leading edge of the cam lock 86 to rise moving the cams to the release position shown in FIG. 14.

One could substitute a dog leg part for each of the cams in the illustrated embodiments. The cam configurations in those embodiments were selected over a dog leg because the selected cam configurations are shorter. One could also substitute a second cam for each roller. Then the lift cords would pass between two cams. If a second cam is used a stop should be provided to prevent the second cam from rotating 360°.

Figure 17:
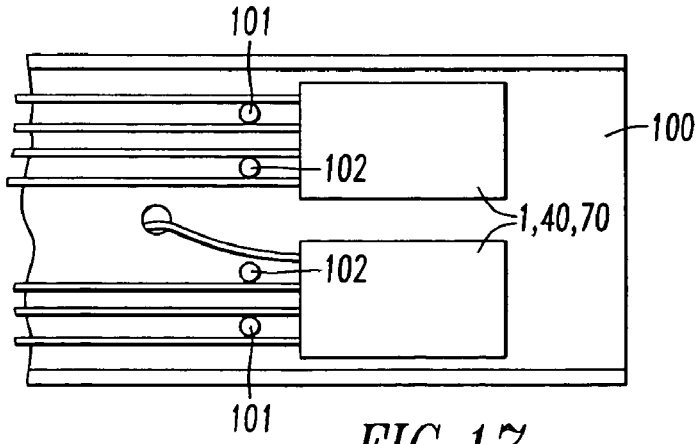
FIG. 17 is a top plan view of portion of a headrail into which two of our cord locks have been installed.

When our cord lock 1, 40, or 70 is installed in a headrail 100 as shown on FIG. 17 we prefer to provide a guide pin 101, 102 for each pair of cords. The guide pins direct the cords to positions below one of the cams. When guide pins are used in the manner shown in FIG. 17 it is unlikely that one lift cord will interfere with another lift cord or shift to a position in which two lift cords are adjacent a single cam. Two cord locks and associated pins are shown in FIG. 10, but any number of cord locks can be arranged in the headrail. When two or more cord locks are used the additional lift cords passing through one cord lock would be routed over or around the other cord locks. A single release cord (not shown) is connected to both cod locks.

All of the components of the cord lock could be made of plastic or metal. We prefer that the cams be metal, preferably brass, so that the teeth in the cams will undergo less wear. The wheels, pins and locking drums also should be metal. The housing preferably is polycarbonate or other plastic.

While we have shown and described certain present preferred embodiments of our cord lock it should be distinctly understood that our invention is not limited thereto but may be variously embodied within the scope of the following claims.

We claim:

1. A cord lock comprising:

a housing;

a plurality of cams attached to the housing at a position to be able to rotate about a first axis from at least one unlocked position to a locked position, and from the locked position to the at least one unlocked position;

a surface spaced apart from the plurality of cams such that a cord passing over the surface will be pressed against the surface and restrained when the plurality of cams are in the locked position, and the cord can freely pass over the surface in at least one direction when the plurality of cams are in the at least one unlocked position;

a cam lock within the housing and capable of assuming a first position in which the plurality of cams are in the locked position, and at least one additional position in which the plurality of cams are engaged by the cam lock and in the at least one unlocked position;

a spring attached to one of the cam lock and the plurality of cams biasing the plurality of cams to the locked position and enabling the plurality of cams to move from the locked position and the cam lock to move from the first position to the at least one unlocked position when a selected force acts on one of the cam lock and a cord positioned within the cord lock; and a release cord attached to the cam lock in a manner so that pulling the release cord moves the cam lock to engage and move the plurality of cams from the locked position positioned within the cord lock to pass over the surface in a direction opposite the one direction.

2. The cord lock of claim 1 also comprising a plurality of teeth attached to the plurality of cams and positioned to engage a cord passing through the cord lock when the plurality of cams are in the locked position.

3. The cord lock of claim 1 also comprising a roller attached to the housing wherein the surface spaced apart from the plurality of cams on the roller.

4. The cord lock of claim 1 also comprising:

at least one additional cam attached to the housing at a position to be able to rotate about the first axis from at least one unlocked position to a locked position, and from the locked position to the at least one unlocked position; and an additional surface spaced apart from the at least one additional cam such that a cord passing over the additional surface will be pressed against the additional surface and restrained when the at least one additional cam is in the locked position, and the cord can freely pass over the additional surface when the at least one additional cam is in the at least one unlocked position.

5. The cord lock of claim 1 wherein there are four cams, two cams positioned on each of opposite sides of the cam lock.

6. The cord lock of claim 1 also comprising:

a second housing spaced apart from the first housing;

a second housing cam within the second housing at a position to be able to rotate about a first axis from at least one unlocked position to a locked position, and from the locked position to either the first unlocked position or at least one unlocked position;

a second housing surface spaced apart from the second housing cam such that a cord passing over the surface will be pressed against the surface and restrained when the second housing cam is in the locked position, the cord can freely pass over the surface when the second housing cam is in the at least one unlocked position, a second housing cam lock attached to the housing and capable of assuming a first position in which the second housing cam is in the locked position, and at least one additional position in which the second housing cam is engaged by the cam lock and in the at least one unlocked position;

a spring attached to the second housing cam lock, biasing the second housing cam lock to the locked position and enabling the second housing cam to move from the locked position to the first unlocked position when a selected force acts in the one direction on a cord positioned within the cord lock, and the release cord attached to the second housing cam lock in a manner so that pulling the release cord moves the second housing cam lock from the locked position to the second unlocked position thereby allowing a cord positioned within the cord lock to pass over the second housing surface in the opposite direction.

7. A cord lock comprising:

a housing, a plurality of cams attached to the housing at a position to be able to rotate about a first axis from a first unlocked position to a locked position, from a second unlocked position to the locked position, and from the locked position to either the first unlocked position or the second unlocked position;

a surface spaced apart from the plurality of cams such that a cord passing over the surface will be pressed against the surface and restrained when the plurality of cams are in the locked position, the cord can freely pass over the surface in one direction when the plurality of cams are in the first unlocked position and the cord can freely pass over the surface in an opposite direction when the plurality of cams are in the second unlocked position, a cam lock attached to the housing and capable of assuming any of at least three positions, a first position in which the plurality of cams are in the locked position, a second position in which the plurality of cams are in the first unlocked position, and a third position in which the plurality of cams are in the second unlocked position;

a spring attached to the cam lock, biasing the cam lock to the locked position and enabling the cam lock to move from the locked position to the first unlocked position when a selected force acts in the one direction on a cord positioned within the cord lock, and a release cord attached to the cam lock in a manner so that pulling the release cord moves the cam lock from the locked position to the second unlocked position thereby allowing a cord positioned within the cord lock to pass over the surface in the opposite direction.

* * * * *